US006529170B1

(12) United States Patent
Nishizawa et al.

(10) Patent No.: US 6,529,170 B1
(45) Date of Patent: Mar. 4, 2003

(54) TWO-FREQUENCY ANTENNA, MULTIPLE-FREQUENCY ANTENNA, TWO- OR MULTIPLE-FREQUENCY ANTENNA ARRAY

(75) Inventors: Kazushi Nishizawa, Tokyo (JP); Hiroyuki Ohmine, Tokyo (JP); Toshio Nishimura, Tokyo (JP); Takashi Katagi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/926,083

(22) PCT Filed: Dec. 26, 2000

(86) PCT No.: PCT/JP00/09272

§ 371 (c)(1),
(2), (4) Date: Aug. 27, 2001

(87) PCT Pub. No.: WO01/48866

PCT Pub. Date: May 7, 2001

(30) Foreign Application Priority Data

Dec. 27, 1999 (JP) ..... 11-371064

(51) Int. Cl.[7] ..... H01Q 1/00
(52) U.S. Cl. ..... 343/795; 343/700 MS

(58) Field of Search ..... 343/795, 749, 343/722, 700 MS, 702, 752, 715, 790

(56) References Cited

U.S. PATENT DOCUMENTS 6,054,962 A * 4/2000 Ha et al. ..... 343/722

FOREIGN PATENT DOCUMENTS

| | | |
|---|---|---|
| JP | 49-46661 | 5/1974 |
| JP | 52-85452 | 7/1977 |
| JP | 4-282903 | 10/1992 |
| JP | 5-327331 | 12/1993 |
| JP | 7-202562 | 8/1995 |
| JP | 8-37419 | 2/1996 |
| JP | 8-186420 | 7/1996 |
| JP | 11-168323 | 6/1999 |

* cited by examiner

*Primary Examiner*—Don Wong
*Assistant Examiner*—James Clinger

(57) ABSTRACT

A two-frequency antenna includes feeders 7*a* and 7*b*, inner radiation elements 2*a* and 2*b* connected to the feeders, outer radiation elements 3*a* and 3*b*, and inductors 4*a* and 4*b* that are formed in gaps 6*a* and 6*b* between the inner radiation elements and the outer radiation elements to connect the two radiation elements, which are printed on the first surface and on the second surface of the dielectric board 1, respectively.

20 Claims, 8 Drawing Sheets

TWO-FREQUENCY ANTENNA, MULTIPLE-FREQUENCY ANTENNA, TWO- OR MULTIPLE-FREQUENCY ANTENNA ARRAY

This application is the national phase under 35 U.S.C. §371 of PCT International Application No. PCT/JP00/09272 which has an International filing date of Dec. 26, 2000, which designated the United States of America and was not published in English.

TECHNICAL FIELD

The present invention relates to a two-frequency printed antenna that is used as a base station antenna in a mobile communication system, and is used in common for two frequency bands which are separated apart from each other, and to a multi-frequency printed antenna used in common for a plurality of frequency bands which are separated apart from each other, and to a two-frequency or multi-frequency array antenna composed of the two- or multi-frequency printed antennas.

BACKGROUND ART

Antennas such as base station antennas for implementing a mobile communication system are usually designed for respective frequencies to meet their specifications, and are installed individually on their sites. The base station antennas are mounted on rooftops, steel towers and the like to enable communications with mobile stations. Recently, it has been becoming increasingly difficult to secure the sites of base stations because of too many base stations, congestion of a plurality of communication systems, increasing scale of base stations, etc. Furthermore, since the steel towers for installing base station antennas are expensive, the number of base stations has to be reduced from the viewpoint of cost saving along with preventing spoiling the beauty.

The base station antennas for mobile communications employ diversity reception to improve communication quality. Although the space diversity is used most frequently as a diversity branch configuration, it requires at least two antennas separated apart by a predetermined distance, thereby increasing the antenna installation space. As for the diversity branch to reduce the installation space, the polarization diversity is effective that utilizes multiple propagation characteristics between different polarizations. This method becomes feasible by using an antenna for transmitting and receiving the vertically polarized waves in conjunction with an antenna for transmitting and receiving the horizontally polarized waves. In addition, utilizing both the vertically and horizontally polarized waves by a radar antenna can realize the polarimetry for identifying an object from a difference between radar cross-sectional areas caused by the polarization.

Thus, to make effective use of space, it is necessary for a single antenna to utilize a plurality of different frequencies, and in addition, the combined use of the polarized waves will further improve its function. FIG. 1 is a plan view showing a conventional two-frequency printed antenna disclosed in Japanese patent application laid-open No. 8-37419/1996. FIG. 2 is a schematic view showing a configuration of a conventional antenna formed as a corner reflector antenna comprising the two-frequency array antenna. In this figures, the reference numeral 101 designates a dielectric board; 102*a* designates a dipole element printed on the first surface of the dielectric board 101; 102*b* designates a dipole element printed on the second surface of the dielectric board 101; 103*a* designates a feeder printed on the first surface of the dielectric board 101; 103*b* designates a feeder printed on the second surface of the dielectric board 101; 104 designates a passive parasitic element; 105 designates reflectors joined to each other; 106 designates a corner reflector composed of two reflectors 105 joined; and 107 designates subreflectors joined to both ends of the corner reflector 106. The right and left dipole elements 102*a* and 102*b* constitute a dipole antenna 102 operating at a particular frequency f1; and the two feeders 103*a* and 103*b* constitute a twin-lead type feeder 103. The parasitic element 104 has a length resonating at a frequency f2 higher than the frequency f1. The antenna as shown in FIG. 2 is a side view of a device configured by adding the corner reflector to the dipole antenna as shown in FIG. 1. In FIG. 2, the dipole antenna 102 and the twin-lead type feeder 103 are shown schematically.

Next, the operation of the conventional antenna will be described.

The dipole antenna has a rather wideband characteristic with a bandwidth of 10% or more. To achieve such a wide bandwidth, however, it is necessary for the height from the reflectors to the dipole antenna to be set at about a quarter of the wavelength of the radio wave or more. Besides, since the dipole antenna forms its beam by utilizing the reflection from the reflectors, when the height to the dipole antenna is greater than a quarter of the wavelength, it has a radiation pattern whose gain is dropped at the front side. Therefore, it is preferable that the height from the reflectors to the dipole antenna be set at about a quarter of the wavelength of the target radio wave.

In the conventional antenna, the dipole antenna 102 fed by the feeder 103 resonates at the frequency f1. When the dipole antenna 102 operates at the frequency f2 higher than the frequency f1, the parasitic element 104 disposed over the dipole antenna 102 resonates at the frequency f2 because of the induction current caused therein by inter-element coupling. Therefore, the dipole antenna 102 and the parasitic element 104 thus arranged can implement two-frequency characteristics. In addition, the beam width can be controlled by utilizing reflected waves from the corner reflector 106 and subreflector 107.

With the foregoing configuration, the conventional antenna can operate at both frequencies f1 and f2. However, the parasitic element 104, which is active at the relatively high frequency f2 and is disposed over the dipole antenna 102 operating at the relatively low frequency f1, presents the following problems: First, it is impossible for the dipole antenna 102 and the parasitic element 104 to be placed at the height of a quarter wavelength of the radio waves of the operating frequency at the same time. Second, because of the effect of the current flowing in the dipole antenna 102 even when the parasitic element 104 is active at the frequency f2, it is difficult to obtain similar beam shapes by controlling the beam width at the frequency f1 and f2. In addition, the corner reflector and subreflectors needed to achieve the beam control present another problem of complicating the structure of the antenna.

The present invention is implemented to solve the foregoing problems. Therefore, an object of the present invention is to provide a two-frequency antenna, a multi-frequency antenna, and a two-frequency or multi-frequency array antenna composed of the foregoing antennas, which can obtain similar beam shapes at individual operating frequencies when the single antenna is used in common for a plurality of operating frequencies.

Another object of the present invention is to provide a two-frequency antenna, a multi-frequency antenna, and a two-frequency or multi-frequency array antenna composed of the foregoing antennas, each of which has a simple structure and can be used in common for a plurality of operating frequencies.

DISCLOSURE OF THE INVENTION

According to a first aspect of the present invention, there is provided a two-frequency antenna comprising: a feeder, an inner radiation element connected to the feeder and an outer radiation element, all of which are printed on a first surface of a dielectric board; an inductor formed in a gap between the inner radiation element and the outer radiation element printed on the first surface of the dielectric board to connect the two radiation elements; a feeder, an inner radiation element connected to the feeder and an outer radiation element, all of which are printed on a second surface of a dielectric board; and an inductor formed in a gap between the inner radiation element and the outer radiation element printed on the second surface of the dielectric board to connect the two radiation elements.

Thus, the two-frequency antenna can operate at the frequency f1 at which the sum length of the inner radiation element, the inductor and the outer radiation element becomes about a quarter of the wavelength. As for the frequency f2 at which the length of the inner radiation element becomes about a quarter of the wavelength, the two-frequency antenna can also operate at the frequency f2 higher than the frequency f1 by matching the resonant frequency of the parallel circuit, which consists of a capacitor based on the capacitive gap and the inductor, to the frequency f2. Therefore, the single antenna can achieve the function of two linear antennas, each having a length of half the wavelength of the radio wave with one of the frequencies f1 and f2. This offers an advantage of being able to implement the two-frequency antenna with the radiation directivity with the same beam shape for the two different frequencies. In addition, since the resonant length that determines the resonant frequency of the linear antenna includes the length of the inductor, the linear antenna has an advantage over an ordinary linear antenna with the same resonant frequency that its size can be reduced.

According to a second aspect of the present invention, there is provided a multi-frequency antenna comprising: a feeder, an inner radiation element connected to the feeder and a plurality of other radiation elements separated apart from each other, all of which are printed on a first surface of a dielectric board; a plurality of inductors, each of which is formed in a gap between adjacent radiation elements printed on the first surface of the dielectric board to connect the two adjacent radiation elements; a feeder, an inner radiation element connected to the feeder and a plurality of other radiation elements separated apart from each other, all of which are printed on a second surface of a dielectric board; and a plurality of inductors, each of which is formed in a gap between adjacent radiation elements printed on the second surface of the dielectric board to connect the two adjacent radiation elements.

This makes it possible for a linear antenna to operate at a resonant frequency f, wherein the linear antenna consists of the antenna elements each of which includes one or more radiation elements and zero or more inductors inside any pair of the corresponding gaps formed on the first and second surfaces, and f is the resonant frequency of the linear antenna, by matching the resonant frequency of the parallel circuit, which consists of the inductors connecting the gaps and capacitors equivalent to the capacitive gaps, to the frequency f. Therefore, the single antenna can operate at three or more operation frequencies by making a set as described above. This offers an advantage of being able to implement the multi-frequency antenna with the radiation directivity with the same beam shape for the three or more different frequencies. In addition, since the resonant length that determines the resonant frequency of the linear antenna includes the length of the inductor, the linear antenna has an advantage over an ordinary linear antenna with the same resonant frequency that its size can be reduced.

Here, the inductor, which is formed in the gap between the inner radiation element and the outer radiation element printed on the first surface of the dielectric board to connect the two radiation elements, may employ a strip line printed on the first surface of the dielectric board as the inductor; and the inductor, which is formed in the gap between the inner radiation element and the outer radiation element printed on the second surface of the dielectric board to connect the two radiation elements, may employ a strip line printed on the second surface of the dielectric board as the inductor.

Since the linear antenna can be formed integrally on the dielectric board by the etching process, it has an advantage of being able to be fabricated at high accuracy with ease.

The inductors, which are formed in the gap between the adjacent radiation elements printed on the first surface of the dielectric board to connect the two adjacent radiation elements, may employ a plurality of strip lines printed on the first surface of the dielectric board as the inductors; and the inductors, which are formed in the gap between the adjacent radiation elements printed on the second surface of the dielectric board to connect the two adjacent radiation elements, may employ a plurality of strip lines printed on the second surface of the dielectric board as the inductors.

Since the linear antenna can be formed integrally on the dielectric board by the etching process, it has an advantage of being able to be fabricated at high accuracy with ease.

The two-frequency antenna may further comprise a notch formed at an intersection of the inner radiation element and the feeder formed on the first surface of the dielectric board; and a notch formed at an intersection of the inner radiation element and the feeder formed on the second surface of the dielectric board.

This makes it possible to change the passage of the current flowing in the inner radiation elements, and hence offers an advantage of being able to shift the operating frequency of the linear antenna to a lower range with little varying the other operating frequency, when the inner radiation elements are considered to be the antenna elements of the linear antenna.

The multi-frequency antenna may further comprise a notch formed at an intersection of the inner radiation element and the feeder formed on the first surface of the dielectric board; and a notch formed at an intersection of the inner radiation element and the feeder formed on the second surface of the dielectric board.

This makes it possible to change the passage of the current flowing in the inner radiation elements, and hence offers an advantage of being able to shift the operating frequency of the linear antenna to a lower range with little varying the other operating frequencies, when the inner radiation elements are considered to be the antenna elements of the linear antenna.

The two-frequency antenna may consist of a Λ-shaped linear antenna or a V-shaped linear antenna, wherein the Λ-shaped linear antenna may comprise an antenna element consisting of the inner radiation element, the inductor and the outer radiation element, which are formed on the first surface of the dielectric board, and an antenna element consisting of the inner radiation element, the inductor and the outer radiation element, which are formed on the second surface of the dielectric board, the two antenna elements forming an angle less than 180 degrees at a side of the feeder; and wherein the V-shaped linear antenna may comprise the antenna element formed on the first surface of the dielectric board, and the antenna element formed on the second surface of the dielectric board, the two antenna elements forming an angle greater than 180 degrees at the side of the feeder.

This offers an advantage of being able to adjust the beam width of the linear antenna in accordance with its application purpose when operating it at the relatively low operating frequency f1 and the relatively high operating frequency f2.

The multi-frequency antenna may consist of a Λ-shaped linear antenna or a V-shaped linear antenna, wherein the Λ-shaped linear antenna may comprise an antenna element consisting of the plurality of radiation elements and the plurality of inductors, which are formed on the first surface of the dielectric board, and an antenna element consisting of the plurality of radiation elements and the plurality of inductors, which are formed on the second surface of the dielectric board, the two antenna elements forming an angle less than 180 degrees at a side of the feeder; and wherein the V-shaped linear antenna may comprise the antenna element formed on the first surface of the dielectric board, and the antenna element formed on the second surface of the dielectric board, the two antenna elements forming an angle greater than 180 degrees at the side of the feeder.

This offers an advantage of being able to adjust the beam width of the linear antenna in accordance with its application purpose when operating it at the relatively low operating frequency f1 and the relatively high operating frequency f2.

The two-frequency antenna may further comprise a ground conductor with a flat surface or curved surface, and a frequency selecting plate with a flat surface or curved surface, wherein the linear antenna may be installed at a position separated apart from the ground conductor by about a quarter of a wavelength of a radio wave with a relatively low operating frequency f1, and the frequency selecting plate may be installed at a position separated apart from the linear antenna by a quarter of a wavelength of a radio wave with a relatively high operating frequency f2, on a side closer to the ground conductor and in substantially parallel with the ground conductor.

This offers an advantage of being able to maximize the gain at the front of the antenna at the two operating frequencies because the height of the linear antenna becomes about a quarter of the wavelength of the radio wave for the individual operating frequencies f1 and f2.

According to a third aspect of the present invention, there is provided a two-frequency array antenna comprising a plurality of two-frequency antennas as defined above, which are arranged in a same single direction or in orthogonal two directions.

As for the two-frequency antenna, this offers an advantage of being able to implement a single polarization two-frequency array antenna or an orthogonal two-polarization two-frequency array antenna, which has the foregoing advantages such as achieving the radiation directivity with the same beam shape for two different frequencies.

According to a fourth aspect of the present invention, there is provided a multi-frequency array antenna comprising a plurality of two-frequency antennas as defined above, which are arranged in a same single direction or in orthogonal two directions.

As for the multi-frequency antenna, this offers an advantage of being able to implement a single polarization multi-frequency array antenna or an orthogonal two-polarization multi-frequency array antenna, which has the foregoing advantages such as achieving the radiation directivity with the same beam shape for two different frequencies.

BEST MODE FOR CARRYING OUT THE INVENTION

The best mode for carrying out the invention will now be described with reference to accompanying drawings to explain the present invention in more detail.

EMBODIMENT 1

Figure 1:
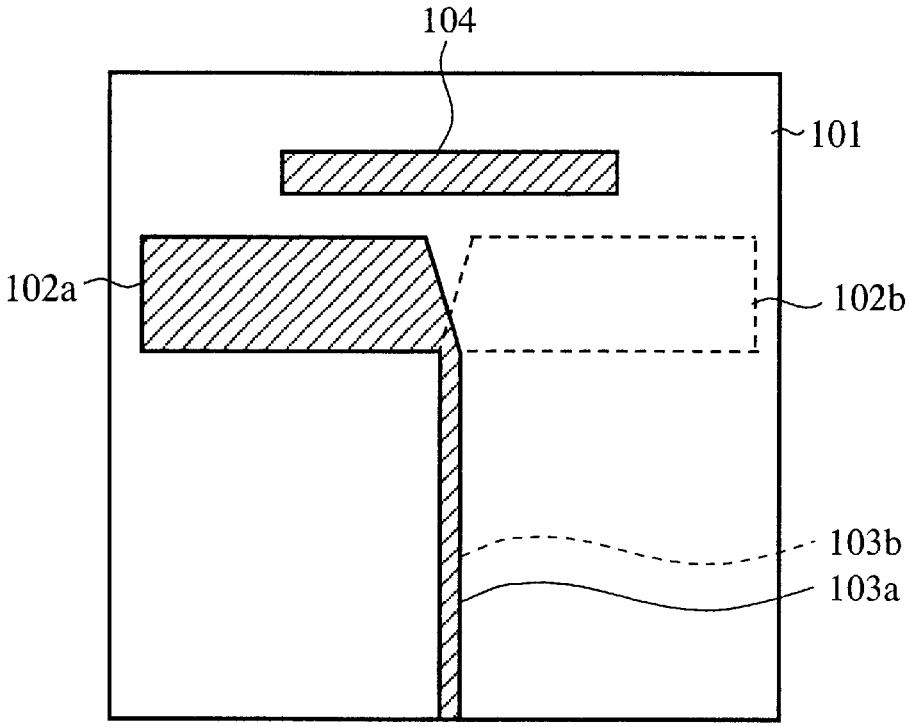
FIG. 1 is a plan view showing a conventional two-frequency printed antenna.
Figure 2:
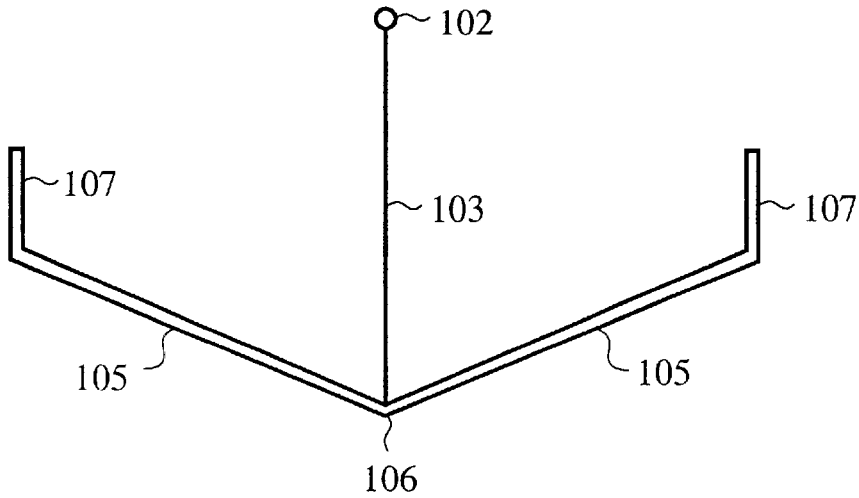
FIG. 2 is a schematic view showing a configuration of a conventional corner reflector antenna.
Figure 3:
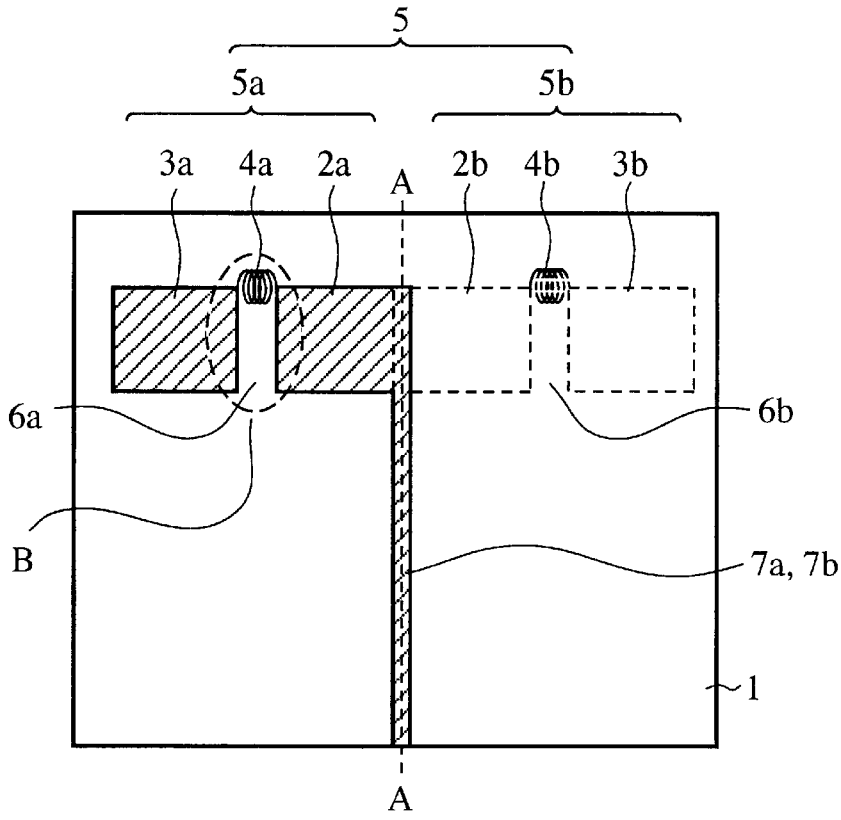
FIG. 3 is a view showing a configuration of a two-frequency antenna of an embodiment 1 in accordance with the present invention.
Figure 4:
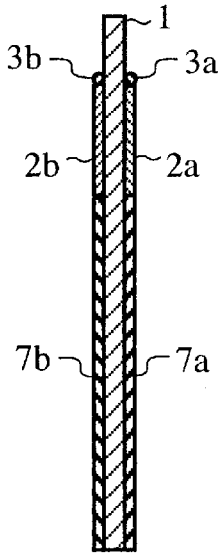
FIG. 4 is a cross-sectional view taken along the A—A line of FIG. 3.

FIG. 3 is a plan view showing a configuration of a two-frequency antenna of the embodiment 1 in accordance with the present invention; and FIG. 4 is a cross-sectional view taken along the A—A line of FIG. 3. In these figures, the reference numeral 1 designates a dielectric board; 2*a* designates an inner radiation element printed on the first surface of the dielectric board 1; 2*b* designates an inner radiation element printed on the second surface of the dielectric board 1; 3*a* designates an outer radiation element printed on the first surface of the dielectric board 1; 3*b* designates an outer radiation element printed on the second surface of the dielectric board 1; 4*a* designates a chip inductor (inductor) interconnecting the inner radiation element 2*a* and the outer radiation element 3*a*; 4*b* designates a chip inductor (inductor) interconnecting the inner radiation element 2*b* and the outer radiation element 3*b*; 5*a* designates a dipole element (antenna element) consisting of the inner radiation element 2*a*, the chip inductor 4*a* and the outer radiation element 3*a* formed on the first surface of the dielectric board 1; 5*b* designates a dipole element (antenna element) consisting of the inner radiation element 2*b*, the chip inductor 4*b* and the outer radiation element 3*b* formed on the second surface of the dielectric board 1; 6*a* designates a gap between the inner radiation element 2*a* and the outer radiation element 3*a*; 6*b* designates a gap between the inner radiation element 2*b* and the outer radiation element 3*b*; 7*a* designates a feeder printed on the first surface of the dielectric board 1; and 7*b* designates a feeder printed on the second surface of the dielectric board 1. The dipole elements 5*a* and 5*b* printed on the first and second surfaces of the dielectric board 1 constitute a dipole antenna 5 (linear antenna). The feeder 7*a* and the feeder 7*b* constitute a twin-lead type feeder. The width of the gaps 6*a* and 6*b* is made narrow so that the gaps have a function to constitute a capacitor.

The sum of the length (electrical length) of the inner radiation element 2*a*, that of the chip inductor 4*a* and that of the outer radiation element 3*a*, and the sum of the length (electrical length) of the inner radiation element 2*b*, that of the chip inductor 4*b* and that of the outer radiation element 3*b* are each set at a quarter of the wavelength of the radio wave with a particular frequency f1. The length of the inner radiation element 2*a* and that of the inner radiation element 2*b* are each set at a quarter of the wavelength of the radio wave with a particular frequency f2 higher than the frequency f1.

Next, the operation of the present embodiment 1 will be described.

When the two-frequency antenna of the present embodiment 1 operates at the frequency f1, the total length (electrical length) of the dipole antenna 5, which comprises the dipole element 5*a* consisting of the inner radiation element 2*a*, chip inductor 4*a* and outer radiation element 3*a*, and the dipole element 5*b* consisting of the inner radiation element 2*b*, chip inductor 4*b* and outer radiation element 3*b*, is about half the wavelength of the radio wave with the frequency f1. Thus, the dipole antenna 5 resonates and operates as an ordinary dipole antenna.

Figure 5:
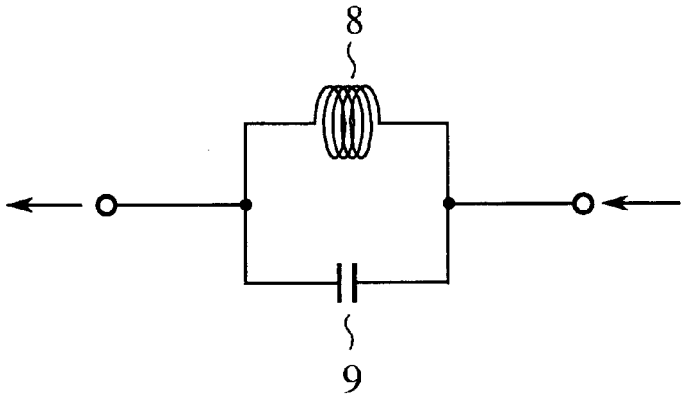
FIG. 5 is a diagram showing an electrically equivalent circuit of a portion B enclosed by a broken line in FIG. 3.
Figure 6:
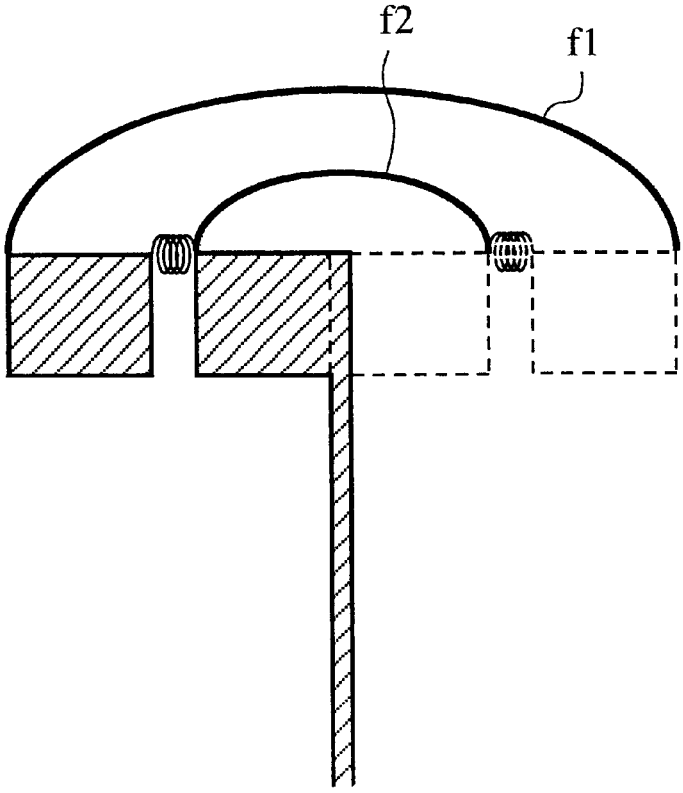
FIG. 6 is a diagram illustrating current distribution on the dipole antenna.

Next, the case where the two-frequency antenna operates at the frequency f2 higher than the frequency f1 will be described. FIG. 5 is a diagram showing an electrically equivalent circuit of the portion B encircled by the broken line of FIG. 3. In this figure, the reference numeral 8 designates a coil having the same inductance as the chip inductor 4*a*; and 9 designates a capacitor having the same capacitance as the capacitive gap 6*a* between the inner radiation element 2*a* and the outer radiation element 3*a*. Thus, the portion B is assumed to be electrically equivalent to the parallel circuit of the coil 8 and the capacitor 9*a*. As for the parallel circuit, the inductance of the coil 8 and the capacitance of the capacitor 9 are set such that it resonates at the frequency f2 higher than the frequency f1. Accordingly, when the two-frequency antenna operates at the frequency f2, the current flowing through the radiation elements 2*a* and 2*b* does not reach the radiation element 3*a* or 3*b* because of the resonance of the equivalent circuit (portion B). In addition, since the sum of the length of the inner radiation element 2*a* and that of the outer radiation element 2*b* is set at about half the wavelength of the radio wave with the frequency f2, the dipole consisting of the inner radiation elements 2*a* and 2*b* resonates, thereby constituting a dipole antenna operating at the frequency f2. FIG. 6 is a diagram illustrating current distribution on the dipole antenna when the dipole antenna operates at the relatively low frequency f1 and at the relatively high frequency f2. As illustrated in this figure, the outer radiation elements 3*a* and 3*b* has little current distribution at the frequency f2 thanks to the operation of the parallel resonance circuits. Thus, the dipole antenna 5 operates as a two-frequency antenna.

Here, to make matching to the frequency f2, it is enough to adjust the position of dividing each of the dipole elements 5*a* and 5*b*, that is, the positions of interposing the chip inductors 4*a* and 4*b*. Besides, the capacitance of the capacitor of the parallel circuit is adjustable by controlling the width of the gaps 6*a* and 6*b* created when dividing each of the dipole elements 5*a* and 5*b*.

As described above, the present embodiment 1is configured such that the inner radiation element 2*a* and the outer radiation element 3*a*, and the inner radiation element 2*b* and the outer radiation element 3*b* are formed on the first surface and second surface of the dielectric board 1 at both sides of the gaps 6*a* and 6*b*, respectively; that the chip inductors 4*a* and 4*b* interconnect the inner radiation elements 2*a* and the outer radiation elements 3*a*, and the inner radiation elements 2*b* and the outer radiation elements 3*b*, to constitute the dipole elements 5*a* and 5*b*, respectively; and that the dipole elements 5*a* and 5*b* on the first surface and the second surface constitute the dipole antenna 5. Thus, the antenna operates at the frequency f1 at which the sum of the inner radiation element 2*a* (2*b*), the chip inductor 4*a* (4*b*) and the outer radiation element 3*a* (3*b*) equals a quarter of the wavelength. Furthermore, by matching the resonant frequency of the parallel circuit, which consists of the capacitor based on the capacitive gap 6*a* (6*b*) and the chip inductor 4*a* (4*b*), to the frequency f2 at which the length of the inner radiation element 4*a* (4*b*) becomes equal to a quarter of the wavelength, the antenna can operate at the frequency f2 higher than the frequency f1. Thus, the single antenna can operate at both the frequencies f1 and f2 as a dipole with about half the wavelength of the radio wave of each frequency. As a result, the present embodiment 1 offers an advantage of being able to implement the radiation directivity having the same beam shape for the different frequencies.

Moreover, since the dipole antenna 5 operating at the frequency f1 maintains the resonant length for the frequency f1 with including the length of the chip inductor, the present embodiment 1offers an advantage of being able to reduce the size of the dipole antenna as compared with the ordinary dipole antenna operating at the frequency f1.

EMBODIMENT 2

Figure 7:
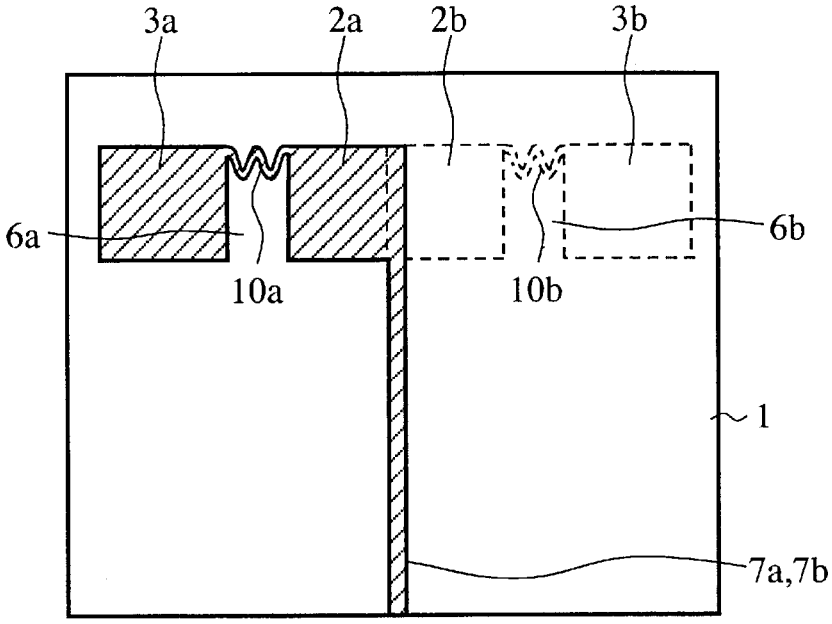
FIG. 7 is a view showing a configuration of a two-frequency antenna of an embodiment 2 in accordance with the present invention.

FIG. 7 is a view showing a configuration of a two-frequency antenna of the embodiment 2 in accordance with the present invention. In this figure, the same reference numerals designate the same or like portions to those of FIG.

3, and the description thereof is omitted here. In FIG. 7, the reference numeral 10*a* designates a meander strip line (strip line) printed on the first surface of the dielectric board 1 to interconnect the inner radiation element 2*a* and the outer radiation element 3*a*; and 10*b* designates a meander strip line (strip line) printed on the second surface of the dielectric board 1 to interconnect the inner radiation element 2*b* and the outer radiation element 3*b*. Although the gaps 6*a* and 6*b* of the divided dipole antenna are drawn as though they were wide, they are actually narrow enough to be capacitive. In addition, although the meander strip lines 10*a* and 10*b* in FIG. 7 are printed near the upper limit of the gaps 6*a* and 6*b* of the divided dipole, they can be formed near the lower limit of them.

Next, the operation of the present embodiment 2 will be described.

The dipole antenna is fabricated on the dielectric board (printed circuit board) 1 by integrally forming the inner radiation elements 2*a* and 2*b*, outer radiation elements 3*a* and 3*b*, strip lines 10*a* and 10*b* and feeders 7*a* and 7*b* by the etching process. Since the operation of the two-frequency antenna at the frequency f1 or f2 is the same as that of the foregoing embodiment 1, the description thereof is omitted here.

Adjusting the width of the gap 6*a* (6*b*) enables the adjustment of the capacitance of the parallel circuit consisting of the strip line 10*a* (10*b*) and the capacitor equivalent to the capacitive gap 6*a* (6*b*). In addition, adjusting the line length of the meander strip lines 10*a* and 10*b* enables the adjustment of the inductance of the parallel circuit.

Figure 8:
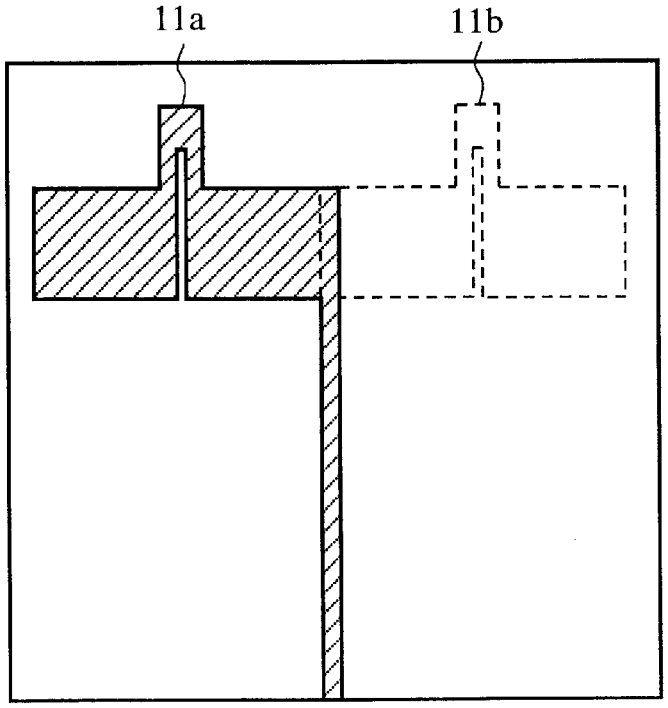
FIG. 8 is a view showing another configuration of a two-frequency antenna of the embodiment 2 in accordance with the present invention.
Figure 9:
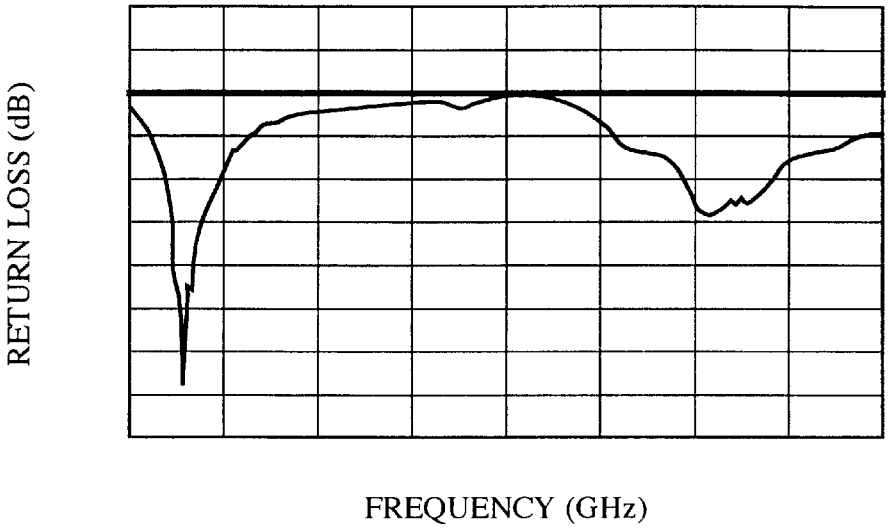
FIG. 9 is a graph illustrating an example of the input impedance characteristic of the dipole antenna.

Although the meander strip lines are used instead of the chip inductors to interconnect the inner radiation elements and the outer radiation elements in the dipole antenna of the present embodiment 2as shown in FIG. 7, this is not essential. For example, they can be connected by crank-like strip lines 11*a* and lib (strip lines) as shown in FIG. 8, achieving similar effect and advantages. FIG. 9 is a graph illustrating an example of the input impedance characteristic of the dipole antenna with the crank-like strip lines.

As described above, the present embodiment 2is configured such that the meander strip lines 10*a* and 10*b* interconnect the inner radiation elements 2*a* and 2*b* and the outer radiation elements 3*a* and 3*b* formed on both sides of the gaps 6*a* and 6*b* on the first surface and the second surface of the dielectric board 1, respectively. Thus, in addition to the advantages of the foregoing embodiment 1, the present embodiment 2 offers an advantage of being able to fabricate the highly accurate dipole antenna easily on the dielectric board 1 by the etching process because the dipole antenna can be formed integrally.

EMBODIMENT 3

Figure 10:
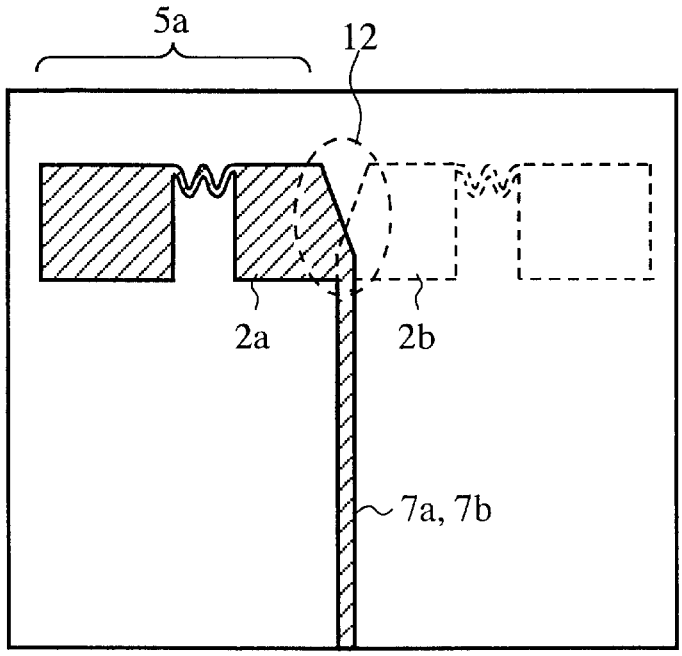
FIG. 10 is a view showing a configuration of a two-frequency antenna of an embodiment 3 in accordance with the present invention.

FIG. 10 is a diagram showing a configuration of the two-frequency array antenna of the embodiment 3 in accordance with the present invention. In this figure, the same reference numerals designate the same or like portions to those of FIG. 3, and the description thereof is omitted here. In FIG. 10, the reference numeral 12 designates a notch formed at the intersection of the inner radiation element 2*a* (2*b*) and the feeder 7*a* (7*b*).

Next, the operation of the present embodiment 3 will be described.

Since the notch 12, which is formed at the intersection of the inner radiation element 2*a* (2*b*) and the feeder 7*a* (7*b*), can alter the passage of the current flowing in the inner radiation element 2*a* (2*b*), the resonant frequencies (operating frequencies) of the two-frequency antenna, the frequency f1 and the frequency f2, and particularly the relatively high frequency f2 can be adjusted. Since the operation of the two-frequency antenna at the frequency f1 or at the frequency f2 is the same as that of the foregoing embodiment 1, the description thereof is omitted here. The shape of the notch is not limited to the oblique one as shown in FIG. 10, but can be changed variously as long as it can alter the passage of the current flowing in the inner radiation element 2*a* (2*b*).

As described above, the embodiment 3 is configured such that it comprises the notch formed at the intersection of the inner radiation element 2*a* (2*b*) and the feeder 7*a* (7*b*). Accordingly, in addition to the advantages of the foregoing embodiment 2, the present embodiment 3 offers an advantage of being able to shift the relatively high frequency f2 to the lower side, without much varying the frequency f1 because the notch can vary the passage of the current flowing in the inner radiation element 2*a* (2*b*)

EMBODIMENT 4

Figure 11:
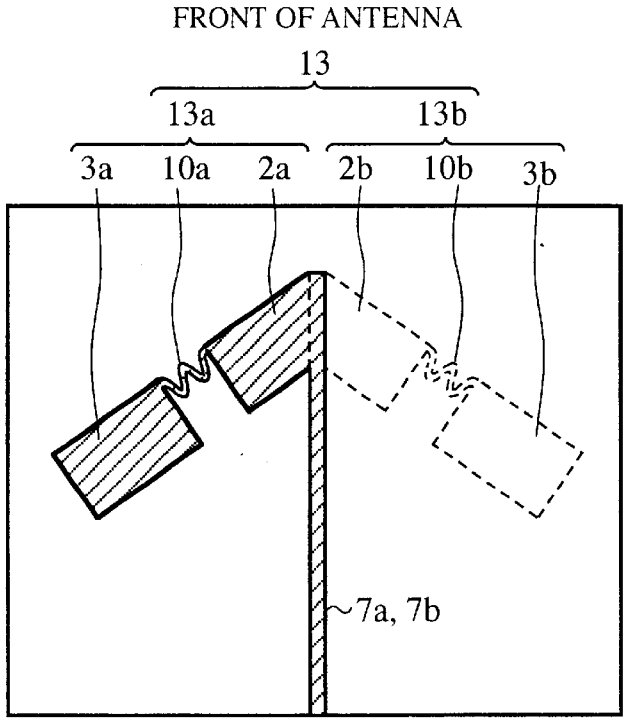
FIG. 11 is a view showing a configuration of a two-frequency antenna of an embodiment 4 in accordance with the present invention.

FIG. 11 is a view showing a configuration of the two-frequency antenna of the embodiment 4in accordance with the present invention. In this figure, the same reference numerals designate the same or like portions to those of FIGS. 3 and 7, and the description thereof is omitted here. In FIG. 11, the reference numeral 13*a* designates a dipole element (antenna element) that consists of the inner radiation element 2*a*, the meander strip line 10*a* and the outer radiation element 3*a*, and that is printed on the first surface of the dielectric board 1 with a tilt with respect to the feeder 7*a*; and 13*b* designates a dipole element (antenna element) that consists of the inner radiation element 2*b*, the meander strip line 10*b* and the outer radiation element 3*b*, and that is printed on the second surface of the dielectric board 1 with a tilt with respect to the feeder 7*b*. The dipole elements 13*a* and 13*b* constitute a Λ-shaped dipole antenna 13 (linear antenna).

Next, the operation of the present embodiment 4 will be described.

Since the operation of the two-frequency antenna at the frequency f1 or f2 is the same as that of the foregoing embodiment 1, the description thereof is omitted here. In this case, since the dipole antenna 13 has a Λ-shape with an angle of less than 180 degrees at the feeder side, it will implement the radiation directivity of a wide beam at the front of the antenna as shown in FIG. 11 at the operating frequencies f1 and f2.

In contrast, when the dipole antenna 13 has a V-shape with an angle equal to or greater than 180 degrees at the feeder side, it will implement the radiation directivity of a narrow beam at the front of the antenna in FIG. 11 at the operating frequencies f1 and f2. Thus, changing the shape of the dipole antenna makes it possible to adjust the radiation directivity appropriately. Besides, the shape of the dipole antenna is not limited to the Λ-shape or V-shape, but can take various shapes.

As described above, according to the embodiment 4, the dipole antenna 13 is configured such that it has a Λ-shape or V-shape. As a result, the present embodiment 4 offers an advantage of being able to appropriately adjust the beam width of the dipole antenna operating at the frequencies f1 and f2 in accordance with an application purpose.

EMBODIMENT 5

Figure 12:
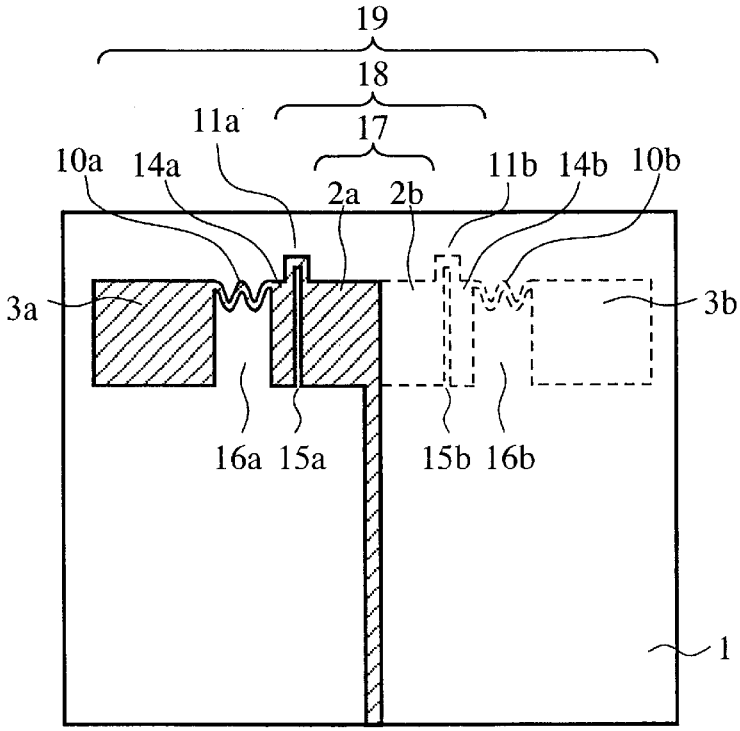
FIG. 12 is a view showing a configuration of a three-frequency antenna of an embodiment 5 in accordance with the present invention.

FIG. 12 is a view showing a configuration of a three-frequency antenna of the embodiment 5 in accordance with the present invention. In this figure, the same reference numerals designate the same or like portions to those of FIGS. 3, 7 and 8, and the description thereof is omitted here. In FIG. 12, the reference numeral 14*a* designates an intermediate radiation element printed between the inner radiation element 2*a* and the outer radiation element 3*a* on the first surface of the dielectric board 1; 14*b* designates an intermediate radiation element printed between the inner radiation element 2*b* and the outer radiation element 3*b* on the second surface of the dielectric board 1; 15*a* designates a gap between the inner radiation element 2*a* and the intermediate radiation element 14*a*; 15*b* designates a gap between the inner radiation element 2*b* and the intermediate radiation element 14*b*; 16*a* designates a gap between the intermediate radiation element 14*a* and the outer radiation element 3*a*; and 16*b* designates a gap between the intermediate radiation element 14*b* and the outer radiation element 3*b*. Although the gaps 16*a* and 16*b* of the divided dipole antenna are drawn as though they were wide, they are actually narrow enough to be capacitive. The inner radiation element 2*a* and the intermediate radiation element 14*a* are joined by the crank-like strip line 11*a*, and the inner radiation element 2*b* and the intermediate radiation element 14*b* are joined by the crank-like strip line 11*b*. The intermediate radiation element 14*a* and the outer radiation element 3*a* are connected by the meander strip line 10*a*, and the intermediate radiation element 14*b* and the outer radiation elements 3*b* are connected by the meander strip line 10*b*.

The reference numeral 17 designates a dipole comprising the inner radiation elements 2*a* and 2*b* as its dipole elements; 18 designates a dipole comprising the dipole element that consists of the inner radiation element 2*a*, strip line 11*a* and intermediate radiation element 14*a*, and the dipole element that consists of the inner radiation element 2*b*, strip line 11*b* and intermediate radiation element 14*b*; and 19 designates a dipole comprising the dipole element that consists of the inner radiation element 2*a*, strip line 11*a*, intermediate radiation element 14*a*, strip line 10*a* and outer radiation element 3*a*, and the dipole element that consists of the inner radiation element 2*b*, strip line 11*b*, intermediate radiation element 14*b*, strip line 10*b* and outer radiation element 3*b*. The dipole 17 has a total length set to operate at a particular frequency fH; the dipole 18 has a total length set to operate at a frequency fM lower than the frequency fH; and the dipole 19 has a total length set to operate at a frequency fL lower than the frequency fM. The parallel circuit, which is composed of the strip line 11*a* (11*b*) and a capacitor equivalent to the capacitive gap 15*a* (15*b*) is designed to resonate at the frequency fH by setting the inductance of the strip line and the capacitance of the capacitor. Likewise, the parallel circuit, which is composed of the strip line 10*a* (10*b*) and a capacitor equivalent to the capacitive gap 16*a* (16*b*), is designed to resonate at the frequency fM by setting the inductance of the strip line and the capacitance of the capacitor. The inductances and the capacitances can be adjusted in the same manner as described above in connection with the embodiment 2.

Next, the operation of the present embodiment 5 will be described.

When the three-frequency antenna of the present embodiment 5 operates at the lowest operating frequency fL, since the total length (electrical length) of the dipole 19 is about half the wavelength of the radio wave of the frequency fL, the dipole 19 resonates, thereby operating as an ordinary dipole antenna.

When the three-frequency antenna operates at the operating frequency fM higher than the frequency fL, since the parallel circuit comprising the strip line 10*a* (10*b*) and the capacitor equivalent to the gap 16*a* (16*b*) resonates, the current flowing in the intermediate radiation elements 14*a* and 14*b* does not reach the outer radiation element 3*a* or 3*b*. In addition, since the dipole 18 has the total length (electrical length) equal to about half the wavelength of the radio wave of the frequency fM, the dipole 18 resonates, thereby functioning as a dipole antenna operating at the frequency fM.

Finally, when the three-frequency antenna operates at the operating frequency fH higher than the frequency fM, since the parallel circuit comprising the strip line 11*a* (11*b*) and the capacitor equivalent to the gap 15*a* (15*b*) resonates, the current flowing in the inner radiation elements 2*a* and 2*b* does not reach the intermediate radiation element 14*a* or 14*b*. In addition, since the dipole 17 has the total length (electrical length) equal to about half the wavelength of the radio wave of the frequency fH, the dipole 17 resonates, thereby functioning as a dipole antenna operating at the frequency fH.

Incidentally, although the three-frequency antenna of the present embodiment 5 as shown in FIG. 12 employs both the meander strip lines and crank-like strip lines as the strip lines to be interposed into the dipole operating at the frequency fL, it can use the same type strip lines. In addition, other strip lines with various shapes can be used as long as they are inductive. Moreover, the strip lines can be replaced by the chip inductors.

As described above, the embodiment 5 is configured such that the inner radiation elements 2*a* and 2*b*, the intermediate radiation elements 14*a* and 14*b* and the outer radiation elements 3*a* and 3*b* are formed symmetrically on the first and second surfaces of the dielectric board; that the inner radiation element 2*a* (2*b*) is joined with the intermediate radiation element 14*a* (14*b*) by the strip line 11*a* (11*b*), and the intermediate radiation element 14*a* (14*b*) is connected with the outer radiation element 3*a* (3*b*) by the strip line 10*a* (10*b*); that the resonant frequency of the equivalent parallel circuit comprising the strip line 11*a* (11*b*) and the gap 15*a* (15*b*) is made equal to the resonant frequency fH of the dipole 17 including the inner radiation elements 2*a* and 2*b* as its dipole elements; and that the resonant frequency of the equivalent parallel circuit comprising the strip line 10*a* (10*b*) and the gap 16*a* (16*b*) is made equal to the resonant frequency fM of the dipole 18 including the inner radiation elements 2*a* and 2*b*, strip lines 11*a* and 11*b* and the intermediate radiation elements 14*a* and 14*b* as its dipole elements. Thus, in addition to the advantages of the foregoing embodiment 2, the present embodiment 5 offers an advantage of being able to implement the three-frequency antenna including the dipole 17 operating at the frequency fH, the dipole 18 operating at the frequency fM and the dipole 19 operating at the frequency fL, thereby achieving the radiation directivity with a similar beam width for the individual frequencies.

Although the present embodiment is described taking an example of the three-frequency antenna, it is possible to implement multi-frequency antennas for four or more frequencies. More specifically, dipole elements printed on the first and second surfaces of a dielectric board are each divided into a plurality of radiation elements by forming a slot-like gaps, and by linking the adjacent radiation elements with inductors. Then, the resonant frequency f of the dipole, which comprises the dipole elements that each include one or more radiation elements and zero or more inductors formed inside a gap s, is made equal to the resonant frequency of the parallel circuit, which comprises an inductor connecting the radiation elements adjacent to each other via the gap s, and the capacitor equivalent to the capacitive gap s. Thus, the dipole consisting of the dipole elements inside the gaps s functions as a dipole antenna operating at the frequency f. As a result, the multi-frequency antenna is implemented by providing the gaps s to obtain desired operating frequencies.

As for the multi-frequency antenna for three or more frequencies, it has an additional advantage that the notch formed at the intersection of the inner radiation elements and the feeder can shift the highest operating frequency among the plurality of operating frequencies to the lower range as in the foregoing embodiment 3. Furthermore, when the dipole antenna is configured such that it has a Λ-shape or V-shape, it offers an advantage of being able to appropriately adjust the beam width of the dipole antenna operating at the individual frequencies in accordance with an application purpose as in the foregoing embodiment 4.

EMBODIMENT 6

Figure 13:
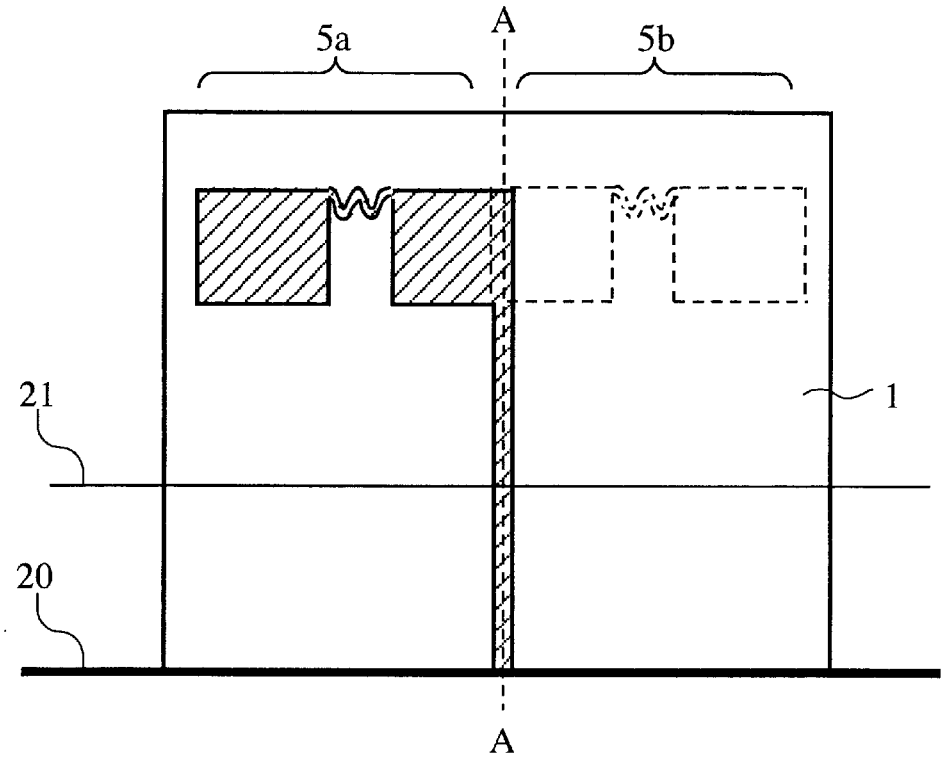
FIG. 13 is a view showing a configuration of a two-frequency antenna of an embodiment 6 in accordance with the present invention.
Figure 14:
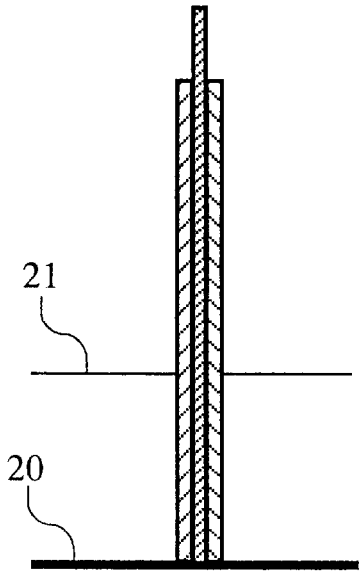
FIG. 14 is a cross-sectional view taken along the A—A line of FIG. 13.

FIG. 13 is a view showing a configuration of the two-frequency antenna of the embodiment 6 in accordance with the present invention. In this figure, the same reference numerals designate the same or like portions to those of FIG. 3, and the description thereof is omitted here. In FIG. 13, the reference numeral 20 designates a ground conductor placed perpendicularly to the dielectric board 1; and 21 designates a frequency selecting plate also placed perpendicularly to the dielectric board 1. In the two-frequency antenna, the frequency selecting plate 21 has a characteristic of transmitting a radio wave of the relatively low operating frequency f1, and reflecting a radio wave of the relatively high operating frequency f2. In addition, the dipole antenna 5 is installed such that its height from the ground conductor 20 becomes about a quarter of the wavelength of the radio wave of the frequency f1, and the frequency selecting plate 21 is installed closer to the ground conductor 50 such that its distance from the dipole antenna 5 becomes a quarter of the wavelength of the radio wave of the frequency f2.

Next, the operation of the present embodiment 6 will be described.

As described before in connection with the conventional two-frequency antenna, when generating a beam using the reflection from the ground conductor or reflector, the dipole antenna exhibits the radiation directivity that drops its gain at its front when its height from the ground conductor exceeds a quarter of the wavelength of the radio wave of the operating frequency. Accordingly, it is appropriate to set the height of the dipole antenna at about a quarter of the wavelength of the radio wave of the operating frequency. In the two-frequency antenna of the embodiment 6, since the radio wave of the frequency f1 passes through the frequency selecting plate 21 and is reflected off the ground conductor 20, the height of the dipole operating at the frequency f1 corresponds to the distance between the dipole antenna 5 and the ground conductor 20. On the other hand, since the radio wave of the frequency f2 is reflected off the frequency selecting plate 21, the height of the dipole operating at the frequency f2 corresponds to the distance between the dipole antenna 5 and the frequency selecting plate 21. Thus, the height of the dipole operating at the frequency f1 or f2 becomes about a quarter of the wavelength of the radio wave of each operating frequency, thereby preventing the gain of the antenna from being dropped at the front at both the frequencies.

As described above, the embodiment 6 is configured such that the two-frequency antenna is installed at the position apart from the ground conductor by about a quarter of the wavelength of the radio wave with the relatively low operating frequency f1, and that the frequency selecting plate, which transmits the radio wave with the relatively low operating frequency f1 and reflects the radio wave with the relatively high operating frequency f2, is placed at the position closer to the ground conductor and apart from the two-frequency antenna by about a quarter of the wavelength of the radio wave with the relatively high frequency f2. As a result, the present embodiment 6 offers an advantage of being able to maximize the gain at the front of the antenna at the two operating frequencies, because the height of the dipole becomes about a quarter of the wavelength of the radio wave of each of the operating frequencies f1 and f2.

EMBODIMENT 7

Figure 15:
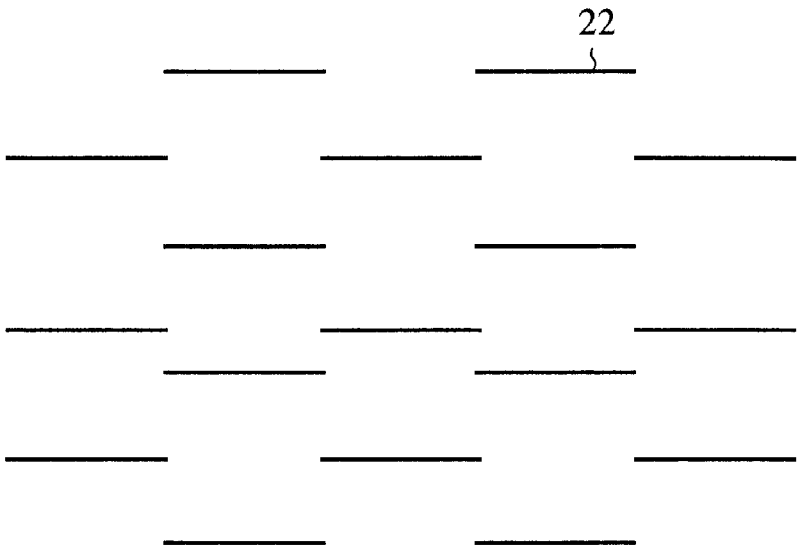
FIG. 15 is a view showing a configuration of a two-frequency or multi-frequency array antenna of an embodiment 7 in accordance with the present invention.

FIG. 15 is a diagram showing a configuration of a two-frequency or multi-frequency array antenna of the embodiment 7 in accordance with the present invention. In this figure, the reference numeral 22 designates a two-frequency or multi-frequency antenna described in the foregoing embodiments 1–6.

In the present embodiment, the individual two-frequency or multi-frequency antennas 22 are arranged regularly in the same direction as the element antennas, thereby constituting a single-polarization two-frequency or multi-frequency array antenna. FIG. 15 shows a horizontal polarization array antenna.

As described above, the two-frequency or multi-frequency array antenna of the present embodiment 7 in accordance with the present invention is configured by regularly arranging a plurality of element antennas consisting of the two-frequency or multi-frequency antennas in the same direction. Thus, the present embodiment 7 offers an advantage of being able to implement a single-polarization array antenna using the two-frequency or multi-frequency antennas described in the foregoing embodiments 1–6.

EMBODIMENT 8

Figure 16:
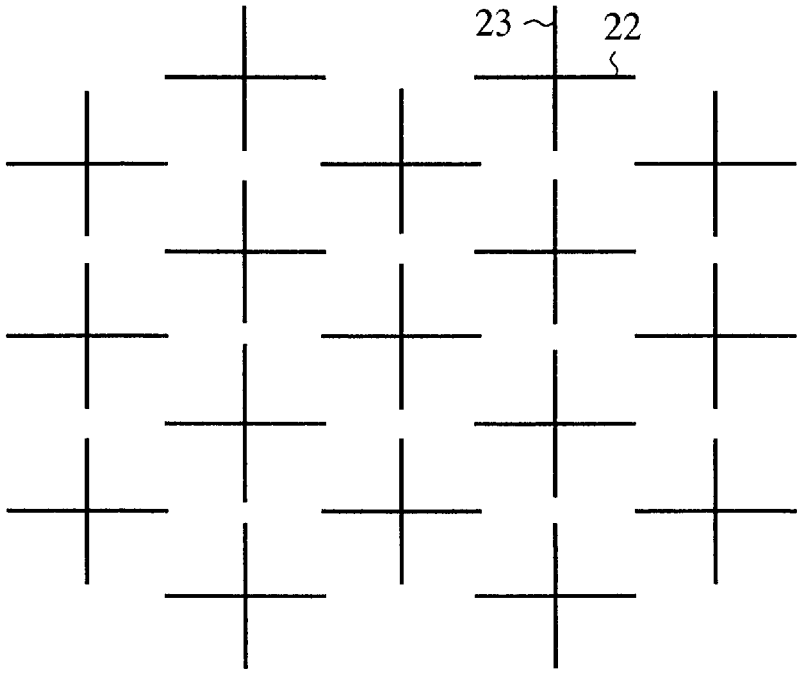
FIG. 16 is a view showing a configuration of a two-frequency or multi-frequency array antenna of an embodiment 8 in accordance with the present invention.

FIG. 16 is a diagram showing a configuration of a two-frequency or multi-frequency array antenna of the embodiment 8 in accordance with the present invention. In this figure, the reference numeral 22 designates a horizontal-polarization two-frequency or multi-frequency antenna; and 23 designates a vertical-polarization two-frequency or multi-frequency antenna.

Using the individual two-frequency or multi-frequency antennas 22 and 23 as the element antennas, the present embodiment arranges a plurality of horizontal-polarization antennas 22 regularly in the horizontal direction, and a plurality of vertical-polarization antennas 23 regularly in the vertical direction, thereby configuring an orthogonal two-polarization two-frequency or multi-frequency array antenna.

Although the array antenna as shown in FIG. 16 employs the horizontally polarized wave and vertically polarized wave as the orthogonal two polarizations, the array antenna of the present embodiment is applicable to any orthogonal two polarizations. In addition, although the configuration is shown in FIG. 16 which comprises the horizontal polarization element antennas and the vertical polarization element antennas that cross each other, other configurations are possible such as placing them in a T-like fashion by displacing their relative positions.

As described above, the two-frequency or multi-frequency array antenna of the present embodiment 8 in accordance with the present invention, employing the two-frequency antennas and multi-frequency antennas as the element antennas, is configured by regularly arranging a plurality of horizontal polarization element antennas in the horizontal direction, and by regularly arranging a plurality of vertical polarization element antennas in the vertical direction. Thus, the present embodiment 8 can implement the orthogonal two-polarization array antenna using the two-frequency or multi-frequency antennas with the advantages described in the foregoing embodiments 1–6.

INDUSTRIAL APPLICABILITY

As described above, the two-frequency antenna and the multi-frequency antenna in accordance with the present invention are suitable for obtaining substantially the same beam shape for a plurality of operating frequencies by using a single antenna.

What is claimed is:

1. A two-frequency antenna comprising:

a first feeder, a first inner radiation element connected to the first feeder, and a first outer radiation element, all of which are printed on a first surface of a dielectric board;

a first inductor formed in a gap between the first inner radiation element and the first outer radiation element printed on the first surface of the dielectric board to connect the first inner and outer radiation elements;

a second feeder, a second inner radiation element connected to the second feeder, and a second outer radiation element, all of which are printed on a second surface of a dielectric board;

a second inductor formed in a gap between the second inner radiation element and the second outer radiation element printed on the second surface of the dielectric board to connect the second inner and outer radiation elements;

a first notch formed at an intersection of the first inner radiation element and the first feeder formed on the first surface of the dielectric board; and a second notch formed at an intersection of the second inner radiation element and the second feeder formed on the second surface of the dielectric board.

2. The two-frequency antenna according to claim 1, wherein said first inductor, which is formed in the gap between the first inner radiation element and the first outer radiation element printed on the first surface of the dielectric board to connect the first inner and outer radiation elements, employs a first strip line printed on the first surface of the dielectric board as the first inductor; and said second inductor, which is formed in the gap between the second inner radiation element and the second outer radiation element printed on the second surface of the dielectric board to connect the second inner and outer radiation elements, employs a second strip line printed on the second surface of the dielectric board as the second inductor.

3. The two-frequency antenna according to claim 1, wherein said two-frequency antenna comprises a Λ-shaped linear antenna, wherein said Λ-shaped linear antenna comprises a first antenna element comprising the first inner radiation element, the first inductor, and the first outer radiation element, which are formed on the first surface of the dielectric board, and a second antenna element comprising the second inner radiation element, the second inductor, and the second outer radiation element, which are formed on the second surface of the dielectric board, the first and second antenna elements forming an angle less than 180 degrees at a side of the feeder.

4. The two-frequency antenna according to claim 1, wherein said two-frequency antenna comprises a V-shaped linear antenna, wherein said V-shaped linear antenna comprises the first antenna element formed on the first surface of the dielectric board, and the second antenna element formed on the second surface of the dielectric board, the first and second antenna elements forming an angle greater than 180 degrees at the side of the feeder.

5. A multi-frequency antenna comprising:

a first feeder, a first inner radiation element connected to the first feeder, and a plurality of other first radiation elements separated apart from each other, all of which are printed on a first surface of a dielectric board;

a plurality of first inductors, each of which is formed in a gap between adjacent first radiation elements printed on the first surface of the dielectric board to connect two adjacent first radiation elements;

a second feeder, a second inner radiation element connected to the second feeder, and a plurality of other second radiation elements, separated apart from each other, all of which are printed on a second surface of a dielectric board; and a plurality of second inductors, each of which is formed in a gap between adjacent second radiation elements printed on the second surface of the dielectric board to connect two adjacent second radiation elements.

6. The multi-frequency antenna according to claim 5, wherein said plurality of first inductors, which are formed in the gap between the adjacent first radiation elements printed on the first surface of the dielectric board to connect the two adjacent first radiation elements, employ a plurality of first strip lines printed on the first surface of the dielectric board as the plurality of first inductors; and said second inductors, which are formed in the gap between the adjacent second radiation elements printed on the second surface of the dielectric board to connect the two adjacent second radiation elements, employ a plurality of second strip lines printed on the second surface of the dielectric board as the plurality of second inductors.

7. The multi-frequency antenna according to claim 5, further comprising a first notch formed at an intersection of the first inner radiation element and the first feeder formed on the first surface of the dielectric board; and a second notch formed at an intersection of the second inner radiation element and the second feeder formed on the second surface of the dielectric board.

8. The multi-frequency antenna according to claim 5, wherein said multi-frequency antenna comprises a Λ-shaped linear antenna, wherein said Λ-shaped linear antenna comprises a first antenna element comprises the plurality of first radiation elements and the plurality of first inductors, which are formed on the first surface of the dielectric board, and a second antenna element comprises the plurality of second radiation elements and the plurality of second inductors, which are formed on the second surface of the dielectric board, the first and second antenna elements forming an angle less than 180 degrees at a side of the feeder.

9. The multi-frequency antenna according to claim 5, wherein said multi-frequency antenna comprises a V-shaped linear antenna, wherein said V-shaped linear antenna comprises the first antenna element formed on the first surface of the dielectric board, and the second antenna element formed on the second surface of the dielectric board, the first and second antenna elements forming an angle greater than 180 degrees at the side of the feeder.

10. A two-frequency antenna comprising:

a first feeder, a first inner radiation element connected to the first feeder, and a first outer radiation element, all of which are printed on a first surface of a dielectric board;

a first inductor formed in a gap between the first inner radiation element and the first outer radiation element printed on the first surface of the dielectric board to connect the first inner and outer radiation elements;

a second feeder, a second inner radiation element connected to the second feeder, and a second outer radiation element, all of which are printed on a second surface of a dielectric board;

a second inductor formed in a gap between the second inner radiation element and the second outer radiation element printed on the second surface of the dielectric board to connect the second inner and outer radiation elements; and a ground conductor with a flat surface or curved surface, and a frequency selecting plate with a flat surface or curved surface, wherein the linear antenna is installed at a position separated apart from the ground conductor by about a quarter of a first wavelength of a radio wave with a relatively low operating frequency f1, and the frequency selecting plate is installed at a position separated apart from the linear antenna by a quarter of a second wavelength of a radio wave with a relatively high operating frequency f2, on a side closer to the ground conductor and substantially parallel with the ground conductor.

11. A two-frequency array antenna comprising a plurality of two-frequency antennas which are arranged in a same single direction or in orthogonal two directions, each of said plurality of two-frequency antennas comprising:

a first feeder, a first inner radiation element connected to the first feeder, and a first outer radiation element, all of which are printed on a first surface of a dielectric board;

a first inductor formed in a gap between the first inner radiation element and the first outer radiation element printed on the first surface of the dielectric board to connect the first inner and outer radiation elements;

a second feeder, a second inner radiation element connected to the second feeder, and a second outer radiation element, all of which are printed on a second surface of a dielectric board;

a second inductor formed in a gap between the second inner radiation element and the second outer radiation element printed on the second surface of the dielectric board to connect the second inner and outer radiation element;

a first notch formed at an intersection of the first inner radiation element and the first feeder formed on the first surface of the dielectric board; and a second notch formed at an intersection of the second inner radiation element and the second feeder formed on the second surface of the dielectric board.

12. The two-frequency array antenna according to claim 11, wherein said first inductor, which is formed in the gap between the first inner radiation element and the first outer radiation element printed on the first surface of the dielectric board to connect the first inner and outer radiation elements, employs a first strip line printed on the first surface of the dielectric board as the first inductor; and said second inductor, which is formed in the gap between the second inner radiation element and the second outer radiation element printed on the second surface of the dielectric board to connect the second inner and outer radiation elements, employs a second strip line printed on the second surface of the dielectric board as the second inductor.

13. The two-frequency array antenna according to claim 11, wherein said two-frequency antenna comprises a Λ-shaped linear antenna, wherein said Λ-shaped linear antenna comprises a first antenna element including the first inner radiation element, the first inductor, and the first outer radiation element, which are formed on the first surface of the dielectric board, and a second antenna element comprising the second inner radiation element, the second inductor, and the second outer radiation element, which are formed on the second surface of the dielectric board, the first and second antenna elements forming an angle less than 180 degrees at a side of the feeder.

14. The two-frequency array antenna according to claim 11, wherein said two-frequency antenna comprises a V-shaped linear antenna, wherein said V-shaped linear antenna comprises the first antenna element formed on the first surface of the dielectric board, and the second antenna element formed on the second surface of the dielectric board, the first and second antenna elements forming an angle greater than 180 degrees at the side of the feeder.

15. A two-frequency array antenna comprising a plurality of two-frequency antennas which are arranged in a same single direction or in orthogonal two directions, each of said plurality of two-frequency antennas comprising:

a first feeder, a first inner radiation element connected to the first feeder, and a first outer radiation element, all of which are printed on a first surface of a dielectric board;

a first inductor formed in a gap between the first inner radiation element and the first outer radiation element printed on the first surface of the dielectric board to connect the first inner and outer radiation elements;

a second feeder, a second inner radiation element connected to the second feeder, and a second outer radiation element, all of which are printed on a second surface of a dielectric board;

a second inductor formed in a gap between the second inner radiation element and the second outer radiation element printed on the second surface of the dielectric board to connect the second inner and outer radiation element; and a ground conductor with a flat surface or curved surface, and a frequency selecting plate with a flat surface or curved surface, and wherein the linear antenna is installed at a position separated apart from the ground conductor by about a quarter of a wavelength of a first radio wave with a relatively low operating frequency f1, and the frequency selecting plate is installed at a position separated apart from the linear antenna by a quarter of a wavelength of a second radio wave with a relatively high operating frequency f2, on a side closer to the ground conductor and substantially parallel with the ground conductor.

16. A multi-frequency array antenna comprising a plurality of multi-frequency antennas which are arranged in a same single direction or in orthogonal two directions, each of said plurality of multi-frequency antennas comprising:

a first feeder, a first inner radiation element connected to the first feeder, and a plurality of other first radiation elements, separated apart from each other, all of which are printed on a first surface of a dielectric board;

a plurality of first inductors, each of which is formed in a gap between adjacent first radiation elements printed on the first surface of the dielectric board to connect two adjacent first radiation elements;

a second feeder, a second inner radiation element connected to the second feeder, and a plurality of other second radiation elements, separated apart from each other, all of which are printed on a second surface of a dielectric board; and a plurality of second inductors, each of which is formed in a gap between adjacent second radiation elements printed on the second surface of the dielectric board to connect two adjacent second radiation elements.

17. The multi-frequency array antenna according to claim 16, wherein said plurality of first inductors, which are formed in the gap between the adjacent first radiation elements printed on the first surface of the dielectric board to connect the two adjacent first radiation elements, employ a plurality of first strip lines printed on the first surface of the dielectric board as the plurality of first inductors; and said plurality of second inductors, which are formed in the gap between the adjacent second radiation elements printed on the second surface of the dielectric board to connect the two adjacent second radiation elements, employ a plurality of second strip lines printed on the second surface of the dielectric board as the plurality of second inductors.

18. The multi-frequency array antenna according to claim 16, wherein each of said plurality of multi-frequency antennas further comprises a first notch formed at an intersection of the first inner radiation element and the first feeder formed on the first surface of the dielectric board; and a second notch formed at an intersection of the second inner radiation element and the second feeder formed on the second surface of the dielectric board.

19. The multi-frequency array antenna according to claim 16, wherein said multi-frequency antenna comprises a Λ-shaped linear antenna, wherein said Λ-shaped linear antenna comprises a first antenna element comprising the plurality of first radiation elements and the plurality of first inductors, which are formed on the first surface of the dielectric board, and a second antenna element comprising the plurality of second radiation elements and the plurality of second inductors, which are formed on the second surface of the dielectric board, the first and second antenna elements forming an angle less than 180 degrees at a side of the feeder.

20. The multi-frequency array antenna according to claim 16, wherein said multi-frequency antenna comprises a V-shaped linear antenna, wherein said V-shaped linear antenna comprises the first antenna element formed on the first surface of the dielectric board, and the second antenna element formed on the second surface of the dielectric board, the first and second antenna elements forming an angle greater than 180 degrees at the side of the feeder.

* * * * *